US005375755A

United States Patent [19]

Norvell, Jr.

[11] Patent Number: 5,375,755

[45] Date of Patent: Dec. 27, 1994

[54] TOE SPACE STAPLER

[76] Inventor: William L. Norvell, Jr., 112 Kimberly Dr., Edenton, N.C. 27932

[21] Appl. No.: 191,526

[22] Filed: Feb. 4, 1994

[51] Int. Cl.[5] ..... B25C 7/00

[52] U.S. Cl. ..... 227/110; 227/147; 227/156

[58] Field of Search ..... 227/147, 145, 110, 119, 227/156

[56] References Cited

U.S. PATENT DOCUMENTS

| | | | |
|---|---|---|---|
| 389,922 | 9/1888 | Delagneau | 227/147 |
| 2,107,555 | 2/1938 | Walsh | 1/48 |
| 2,752,595 | 7/1956 | Hicks | 1/49 |
| 2,845,103 | 7/1958 | Sypher | 227/147 |
| 3,166,757 | 1/1965 | Downs, Jr. | 1/47 |
| 3,323,568 | 6/1967 | Schmidt | 227/147 |
| 3,563,440 | 2/1971 | Stuart | 227/147 |
| 4,826,066 | 5/1989 | Koester et al. | 227/147 |
| 4,903,882 | 2/1990 | Long | 227/147 |

*Primary Examiner*—Scott A. Smith

*Attorney, Agent, or Firm*—Griffin Butler Whisenhunt & Kurtossy

[57] ABSTRACT

An adapter for a stapler is formed in the shape of a saddle which straddles the neck portion of the stapler. A drive bar is affixed to the upper surface of the saddle and is angled so that when the nose portion of the stapler is inserted into a vertically confined toe space, the drive bar is outside of the toe space and can be actuated to drive a staple within the toe space by exerting a force on the drive bar by, for example, a hammer.

10 Claims, 3 Drawing Sheets

TOE SPACE STAPLER

This invention relates to staplers; more particularly, the invention relates to a stapler used to fasten a covering surface where the covering surface has to be stapled close to the inner confines of a limited space.

BACKGROUND AND OBJECTS OF THE INVENTION

When covering surfaces, for example, a floor covering, have to be stapled to a supporting surface, and the stapling point is located within a confined space, common stapling mechanisms are inadequate. Thus, a common type of stapler, known as a hammer stapler, used to fasten a floor covering around the edges of the floor cannot be used within the toe space created by a cabinet which overhangs the edge of the floor. This is because inadequate vertical space exists within the toe space to allow the hammer stapler sufficient swinging room, so to speak, to drive the staple through the floor covering into the floor to thereby fasten the floor covering to the floor.

Accordingly, it is a primary object of this invention to provide an improved stapler able to function as a stapler within a confined space.

An additional problem in the use of a stapler within a confined environment, such as a toe space created by a cabinet overhanging a floor surface, results when the toe space itself is variable from installation to installation. A stapler, even when modified with a basic version of the invention, for use in only a standard toe space, would not be effective in non-standard toe spaces unless the stapler is also adaptable for varying toe spaces.

Accordingly it is another object of this invention to provide a stapler which can accommodate a great range of toe spaces of variable dimensions.

SUMMARY OF THE INVENTION

According to the invention a stapler is modified, either in original construction or by retro-fit, with a saddle adapter designed to straddle, and be fastened to, a neck portion of a common stapler. The saddle adapter has fastened thereto an angled drive bar, extending at an angle from the neck portion of the stapler. The drive bar rises from the saddle at any preferred angle, or even an adjustable angle, so as to be adapted to be struck on a strike surface from a 25 location outside of the toe space to drive a stapler from a projected nose portion of the stapler extending into the toe space. The saddle straddling the stapler may also be moved along the length of the stapler to keep the striking surface of the drive bar outside of the confined toe space.

The foregoing and other objects, features and advantages of the invention will be apparent from the following more particular description of several preferred embodiments of the invention, as illustrated in the accompanying drawings in which like parts are numbered the same in the various figures.

DETAILED DESCRIPTION

Figure 1:
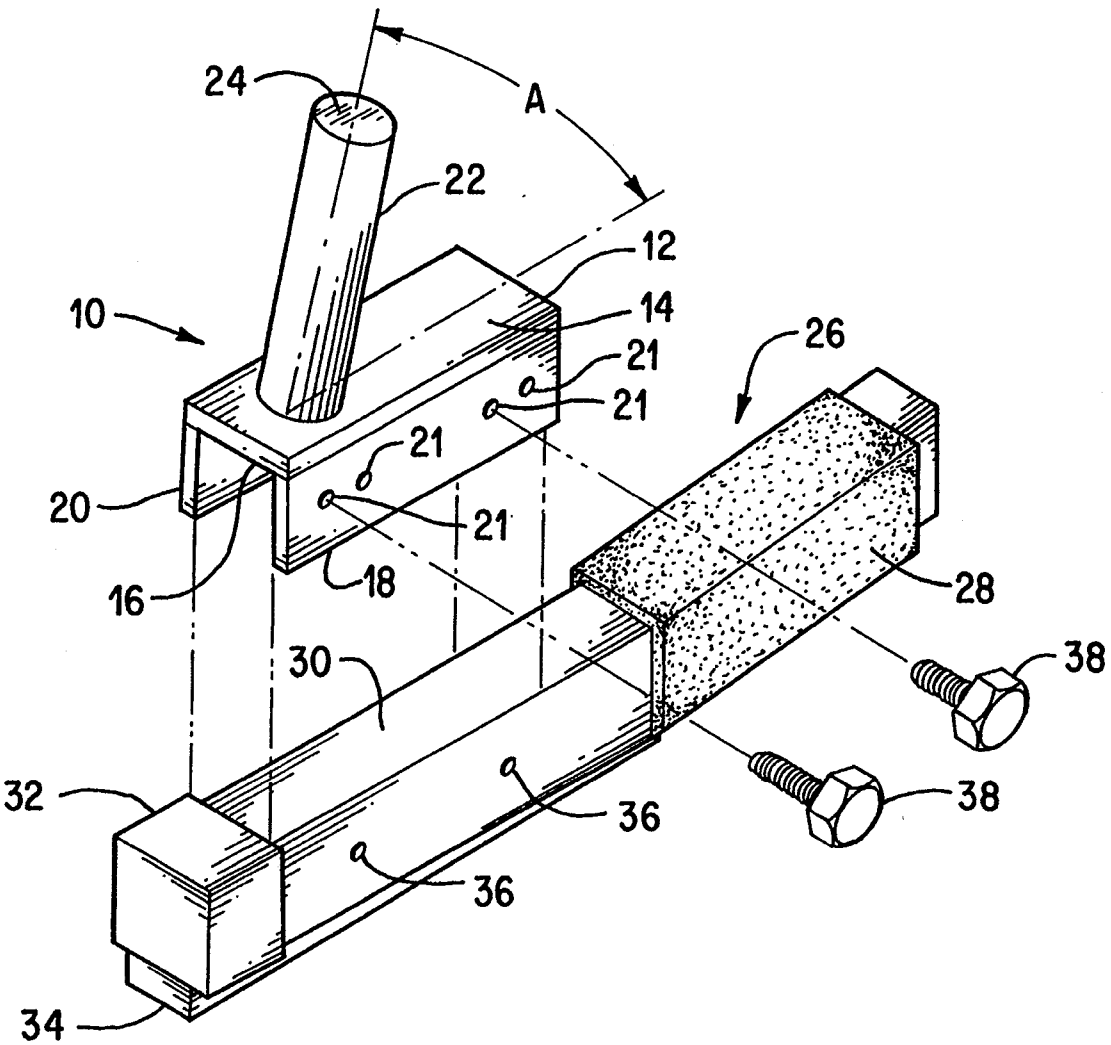
FIG. 1 is an exploded perspective view illustrating a common stapler adapted in accordance with the invention.

With reference to FIG. 1, an adapter, shown generally at 10, is formed in the nature of a saddle 2 having an upper surface 14, a lower surface 16 and two depending side skirts 18 and 20 depending from the saddle 12. The adapter 10 may be fabricated from any suitably rigid material, such as steel, and side skirts 18 and 20 may be welded to the lower surface 16, or the entire unit comprising the saddle 12 may be formed in one unitary piece.

Each of the side skirts 18 and 20 has at least one, but preferably a series of holes 21 formed therein, even though only the holes formed in side skirt 18 are illustrated. Rigidly fastened to saddle 12 is a drive bar 22 on which a striking surface 24 is formed at one end thereof. Drive bar 22 is inclined at an angle A with respect to the plane of the top surface 14 of saddle 12.

Shown generally at 26 is a common hammer stapler having a grip surface 28 and an extended neck portion 30 housing a common stapling mechanism. The stapler 26 has an extended nose portion 32 and the nose portion 32 is hinged (by means not shown) so as to be movable with respect to the base 34 of the stapler 26.

In typical operation the hammer stapler 26, without adapter 10, is swung against a surface to drive a stapler through a covering into a supporting surface, such as a floor.

Both sides of the hammer stapler 26 have holes 36 formed in the extended neck portion 30, even though the holes 36 are shown for only one side. These holes are adapted to match up with the holes 21 of the saddle 12 and a fixed registration between the saddle 12 and the stapler 26 is achieved by screw fasteners 38 passing though holes 21 and 36 into the body of stapler 26. The location of saddle 12 on the elongated neck portion 30 of hammer stapler 26 may be varied by unfastening screw fasteners 38 (on both sides of the saddle 12) and moving another set of holes 21 into registration with holes 36 where upon they are again fixed in that location by the screw fasteners 38. Lockwashers (not shown) may also be utilized with the screw fasteners 38.

Figure 2:
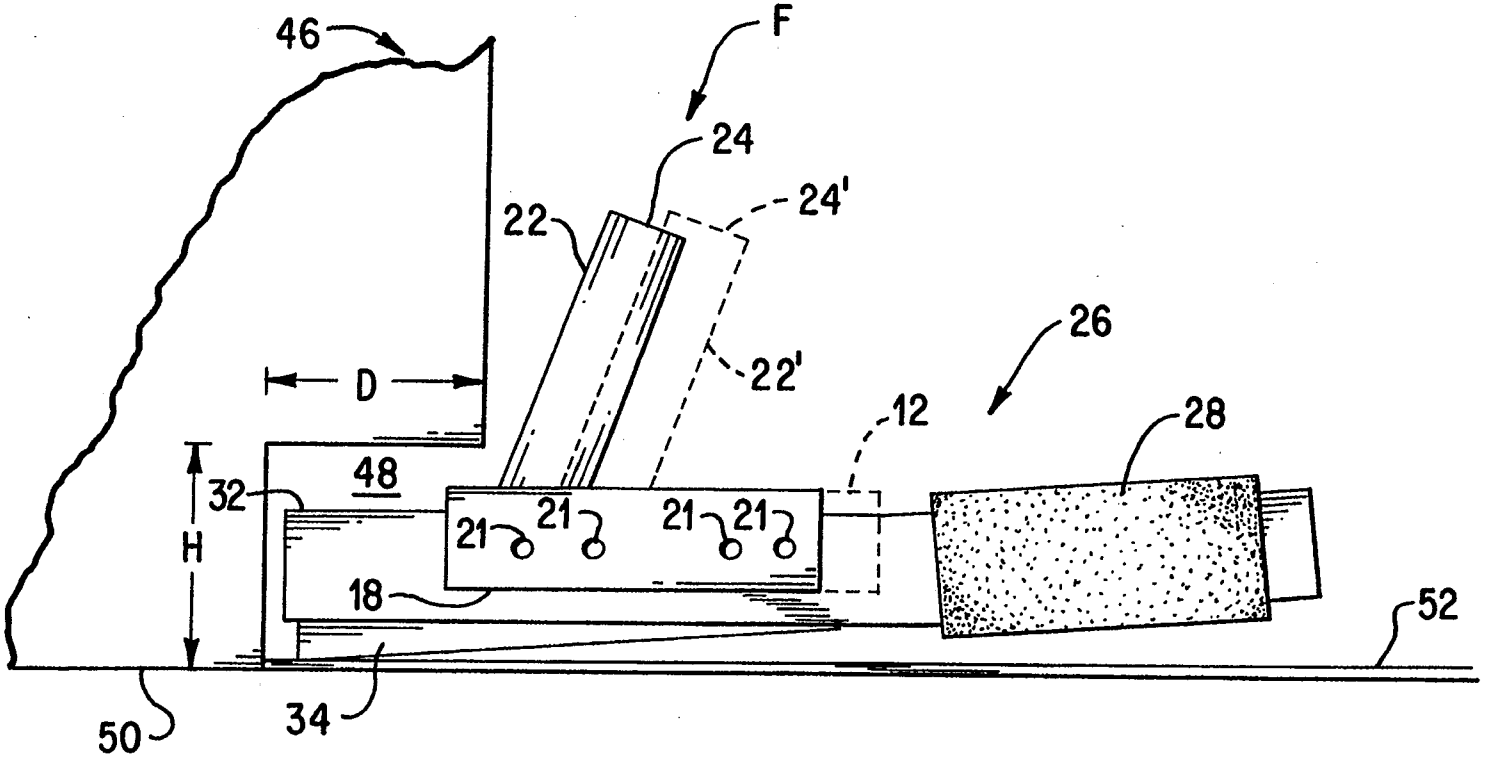
FIG. 2 is a side view of a stapler modified in accordance with the invention as it would be used within a confined space.

With reference to FIG. 2, the hammer stapler 26 is shown in a typical operating situation in which a cabinet, shown generally at 46, defines a toe space 48 having a certain depth D and a certain height H. A floor surface 50 is overlain by a floor covering 52. The hammer stapler 26, as modified by the invention with saddle 12, allows the nose portion 32 of stapler 26 to protrude into the toe space 48 and the stapling action is achieved by exerting a force F, e.g. by a hammer striking the surface 24 of drive bar 22. The force F exerted on the drive bar 22 will force the nose portion 32 to drive a staple contained in the hinged part 34 through the floor covering 52 into secure engagement with floor 50. When the depth D of the toe space is different from, or deeper than, the illustration shown in FIG. 2, the drive bar 22 and its striking surface 24 are moved to the position indicated by the dotted lines 24'and 22'so that a deeper toe space can be accommodated. This adjustment is made by loosening and removing the screw fasteners 38 (shown in FIG. 1) and moving the saddle 12 into a position shown by the dotted lines whereupon the screw fasteners 38 are again inserted in the new registration between holes 21 and 36.

Figure 3:
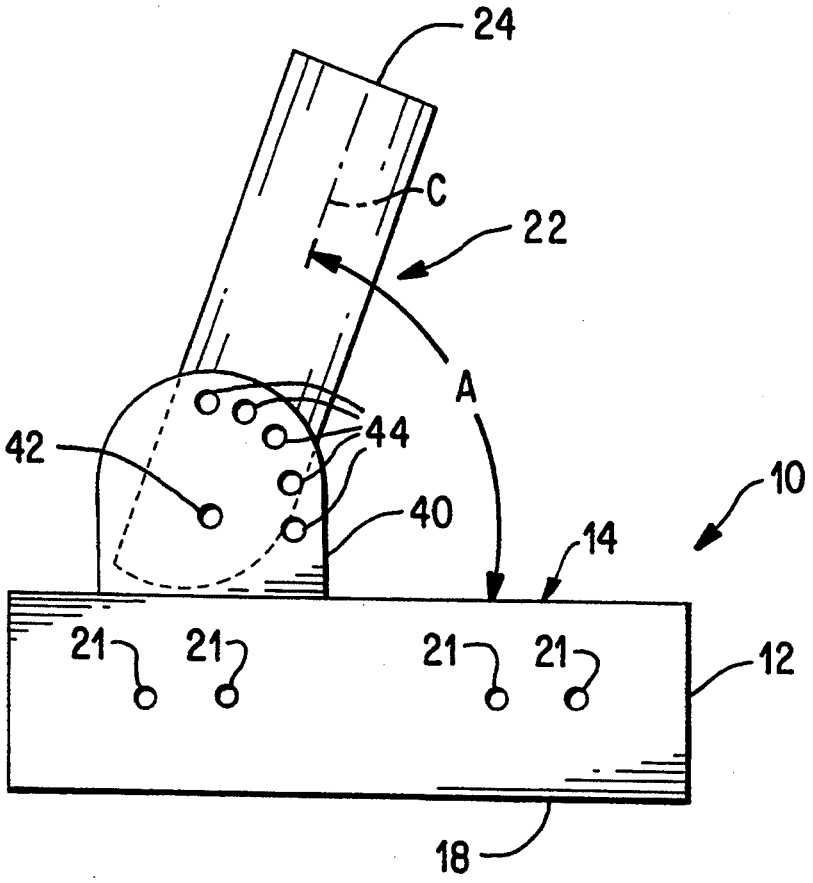
FIG. 3 is a side view of another embodiment of a 20 stapler adapted in accordance with the invention.

With reference to FIG. 3, there is shown a second embodiment of a saddle 12 in which the angle A of the drive bar 22 with respect to the saddle 12 is adjustable. An abutment support 40, provided on both sides of saddle 12, is located in the same (or parallel) plane as depending skirts 18 and 20, and is provided with a pivot hole 42 through which a fastener, (e.g. a bolt) is passed to secure a pivot point about which drive bar 22 can be pivoted. A series of spaced holes 44 are provided in each abutment 40 (corresponding with a single hole along the center line C of drive bar 22, not shown) so that another bolt fastener (not shown) can be removed and allow a different angular orientation to vary the angle A at which the drive bar 22 is inclined with respect to the plane of the upper surface 14.

The angular adjustability of the embodiment shown in FIG. 3, together with the longitudinal adjustability, exemplified by the holes 21 and 36, allows the saddle 12 and its drive bar 22 to assume different orientations so that the nose portion 32 of stapler 26 will be actuable in a toe space 48 having variable depth D and variable height H.

In practice, it has been found that with standard toe spaces (typically 3⅛" high and 3½" deep), the angle A can range from about 65° to 75°, with a preferred angle being approximately 70°. However, other angles may be used for exceptionally deep toe spaces and certainly more than four holes in the side skirts 18 and 20 may be provided to allow a greater range of adjustment as well as a finer adjustment.

While the invention has been particularly shown and described with reference to preferred embodiments thereof, it will be understand by those skilled in the art the foregoing and other changes in form and details may be made therein without departing from the spirit and scope of the invention.

What is claimed is:

1. An adapter to allow a stapler, having an elongated neck to operate within a toe space having limited height and depth comprising:

a saddle having a planar upper surface and skirt means depending from the upper surface so that the saddle can straddle the neck;

a drive bar affixed to the upper surface, the drive bar having an angle with the plane of the upper surface, and the saddle having fixing means for securing the saddle in one position along the neck.

2. Invention according to claim 1 wherein the skirt means are provided with a plurality of holes to register with holes provided in the neck and a removable fastener allows the saddle to assume another position along the neck when the removable fastener is again inserted to register another set of the holes in the skirt means with the holes in the neck.

3. Invention according to claim 2 further including means for varying the angle.

4. Invention according to claim 1 further including means for varying the angle.

5. Invention according to claim 4 wherein the means for varying the angle comprise a pair of side abutments having a plurality of holes spaced around the periphery thereof and a pivot hole and the drive bar contains a pivot hole to register with the first hole in the side abutments and at least one additional hole to register with any one of the plurality of pivot holes in the side abutments, and a pivot support passing through the pivot holes of both the side abutments and the drive bar.

6. In combination:

a stapler having an elongated neck;

a saddle having a planar upper surface and lower surface;

skirt means depending from the lower surface so that the saddle can straddle the neck;

a drive bar affixed to the upper surface, the drive bar having an angle with the plane of the upper surface, the skirt means having fixing means for securing the skirt means in one position along the neck.

7. Invention according to claim 6 wherein the skirt means are provided with a plurality of holes to register with holes provided in the neck and a removable fastener allows the saddle to assume another position along the neck when the removable fastener is again inserted to register another set of the holes in the skirt means with the holes in the neck.

8. Invention according to claim 7 further including means for varying the angle.

9. Invention according to claim 6 further including means for varying the angle.

10. Invention according to claim 8 wherein the means for varying the angle comprise a pair of side abutments, fastened to the saddle, and having a plurality of holes spaced around the periphery thereof and a pivot hole and the drive bar contains a pivot hole to register with the pivot hole in the side abutments and at least one additional hole to register with any one of the plurality of pivot holes in the side abutments, and a pivot support passing through the pivot holes of both the side abutments and the drive bar.

* * * * *